United States Patent [19]

Gobel

[11] Patent Number: 4,614,318

[45] Date of Patent: Sep. 30, 1986

[54] PASSIVE SEPARATION DEVICE AND METHOD FOR FINNED BOOSTER

[75] Inventor: Gerald W. Gobel, Federal Way, Wash.

[73] Assignee: The Boeing Company, Seattle, Wash.

[21] Appl. No.: 631,808

[22] Filed: Jul. 17, 1984

[51] Int. Cl.[4] ..... F42B 15/02

[52] U.S. Cl. ..... 244/3.21; 102/489

[58] Field of Search ..... 244/3.21, 3.24, 3.1; 102/377, 489

[56] References Cited

U.S. PATENT DOCUMENTS

| | | | |
|---|---|---|---|
| 2,936,710 | 5/1960 | Bollay | 244/3.21 |
| 2,941,764 | 6/1960 | Lee et al. | 244/3.22 |
| 3,004,489 | 10/1961 | Griffith et al. | 244/3.21 |
| 3,139,033 | 6/1964 | Geissler et al. | 244/3.21 |
| 3,202,381 | 8/1965 | Wuenscher | 102/378 |
| 3,260,204 | 7/1966 | Wilkey | 244/3.22 |
| 3,305,194 | 2/1967 | Conard et al. | 244/3.21 |
| 3,416,755 | 12/1968 | Knoll et al. | 244/122 |
| 3,437,285 | 4/1969 | Manfredi et al. | 244/158 R |
| 3,568,961 | 3/1971 | Iverson | 244/3.21 |
| 3,589,644 | 6/1971 | Salkeld | 244/164 |
| 4,225,101 | 9/1980 | Brown | 244/122 AE |
| 4,364,530 | 12/1982 | Ripley-Lotee et al. | 244/3.22 |
| 4,389,028 | 6/1983 | Kalivretenos et al. | 244/3.21 |
| 4,498,393 | 2/1985 | Fischer et al. | 102/489 |

*Primary Examiner*—Charles T. Jordan

*Attorney, Agent, or Firm*—Schwartz, Jeffery, Schwaab, Mack, Blumenthal & Evans

[57] ABSTRACT

Apparatus and method for separating two parts of a body in flight, one of which has controllable fins, for example a finned booster and payload section, in which various commands are generated in the forward booster region and stored in the aft booster region, the commands determining a sequence of positions for the booster fins to assume after separation, thus imparting a spinning, tumbling motion to the booster and increasing drag thereon.

10 Claims, 2 Drawing Figures

PASSIVE SEPARATION DEVICE AND METHOD FOR FINNED BOOSTER

The Government has rights in this invention pursuant to Contract No. N00024-81-C-6202 awarded by the U.S. Navy.

BACKGROUND OF THE INVENTION

This invention relates to a method and apparatus for separating with reduced risk of collision two parts of a body in flight, one of the parts having fins. In particular, it relates to the separation with reduced risk of collision of the payload and finned booster segments of a rocket.

When an airborne body is separated into two or more segments, there is a danger that the two segments will collide and thereby damage one another. This danger is especially acute when one of the segments is decelerated with respect to the other as, for example, with a parachute. The previous design solution to the potential collision problem involved maintaining active attitude control of the spent booster after payload separation, relying upon lift forces to fly the booster out from behind the payload. This solution, however, incurred a high risk that the sensitive inertial measurement unit (rate gyros and accelerometers) and the autopilot computer it necessitated would be damaged because both were located in the front end of the booster, the area of greatest ordnance shock during separation.

SUMMARY OF THE INVENTION

This invention relies upon the known aerodynamic and inertial properties of the spent booster. After a predetermined delay, the fins on the booster respond to a set of commands which changes the fins' positions. This imparts a spinning, tumbling motion to the booster which produces lateral aerodynamic forces to push the booster out from behind the payload. The autopilot aboard the forward end of the booster relays control signals to circuitry in the aft end of the booster before the autopilot experiences the potentially damaging shock of payload-booster separation. Thus, the invention results in a relatively simple yet reliable passive system for substantially reducing the likelihood that a booster and payload section of a rocket will collide after separation.

BRIEF DESCRIPTION OF THE DRAWINGS

These and other advantages of the present invention will become better understood from the following description read in conjunction with the drawings, of which.

DETAILED DESCRIPTION OF THE PREFERRED EMBODIMENTS

Figure 1:
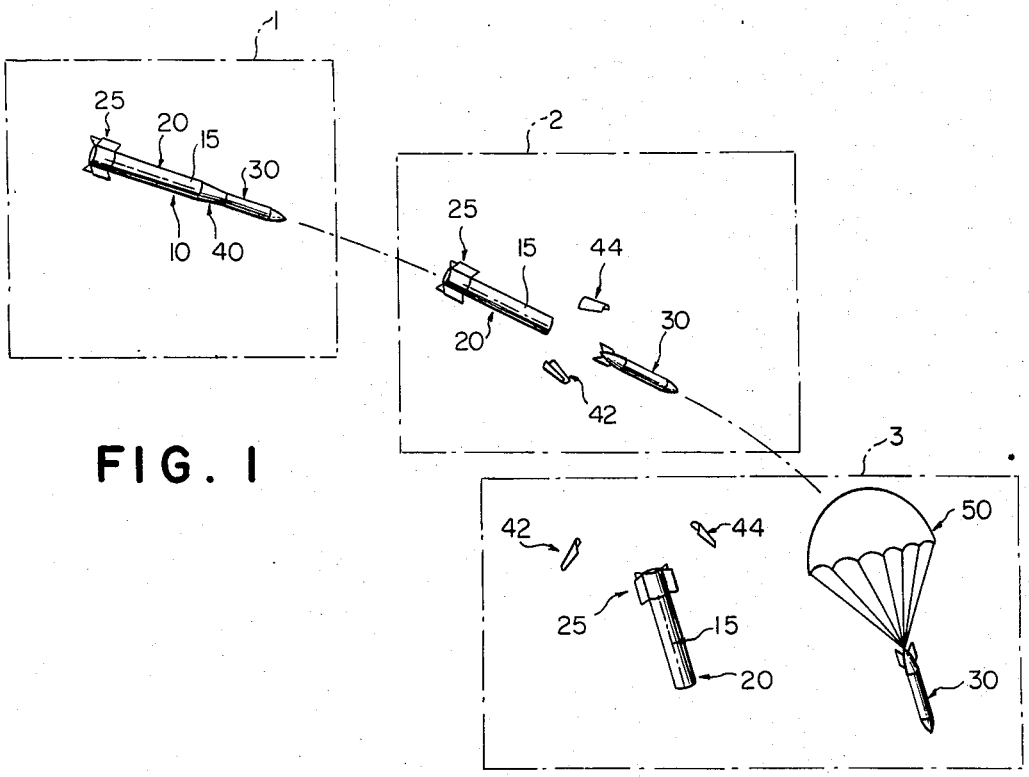
FIG. 1 is a pictorial diagram of a successful separation sequence.

With reference to FIG. 1, shown therein is a diagram of a sequence of events ending in a successful separation. At the extreme left-hand portion of the figure within the phantom box designated 1 can be seen a rocket generally designated by a numeral 10 having a booster section 20, a payload section 30, and a connecting section 40. The booster section 20 is provided with fins 25, and a raceway 15 for conducting fin command signals from the flight computer shown in phantom. This part of the diagram represents a rocket just prior to separation.

The figure within box 2 immediately to the right of that just described shows rocket 10 just after separation has occurred. As depicted therein, connecting section 40 has separated into two pieces 42 and 44. Payload section 30 continues along the path of the original rocket through its own momentum. Booster section 20, which is blunt-ended, is slowed by the air.

The part of the diagram within box 3 below and slightly to the right of that just described shows the next step in the separation sequence when the booster section 30 deploys parachute 50 to slow its descent. As shown in this part of the diagram, ideally, booster section 20 and pieces 42 and 44 of connecting section 40 fall to earth without colliding with payload section 30.

The problem encountered in the prior art, however, as already described, is that booster section 20 does not always fall to earth without colliding with and damaging payload section 30. It is therefore desirable to increase the drag force and the lateral aerodynamic force on booster section 20. In accordance with the present invention, means are provided within rocket 10 for providing commands causing a series of manipulations to means for controlling fins 25 and carrying out that series of manipulations after a predetermined delay. The fin manipulations cause booster 20 shortly after separation to undergo a spinning, tumbling motion which produces lateral aerodynamic forces on the booster and sufficiently impedes its forward motion so that the likelihood of collision with the payload section is substantially decreased.

Figure 2:
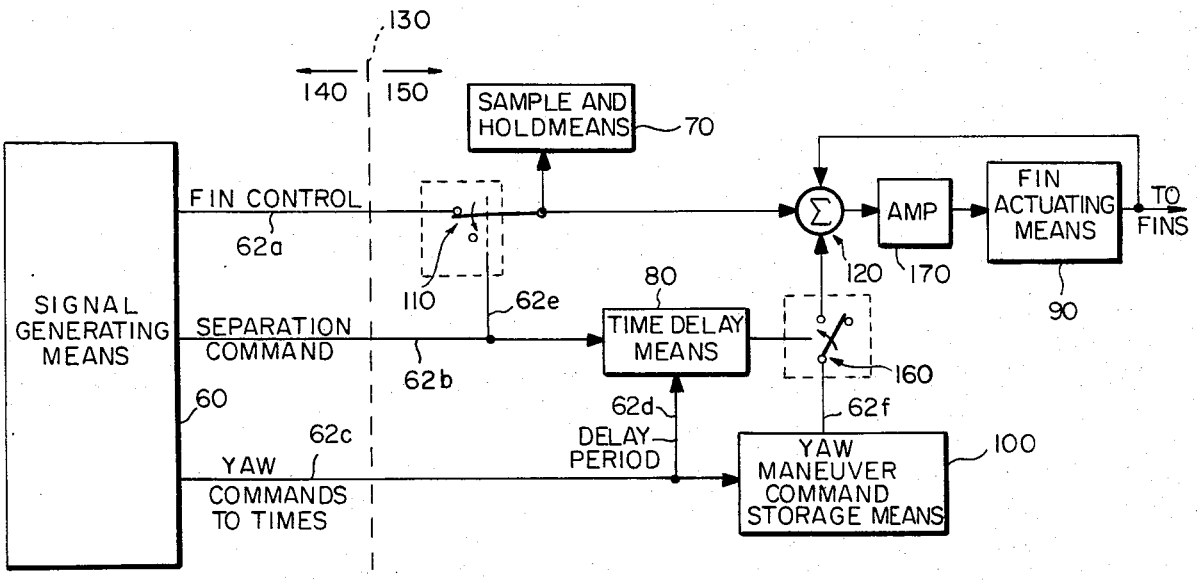
FIG. 2 is a block diagram of a fin control system in accordance with one embodiment of the present invention.

FIG. 2 is a block diagram of the means provided within rocket 10 for effecting delayed control of fins 25. Signal generating means 60 is switchably connected through line **62*a* and switch 110 to sample and hold means 70 and summing point 120, and is also connected to time delay means 80 by line 62*b* and yaw maneuver command storage means 100 by line 62*c*. Any device capable of generating digital commands, preferably the on-board autopilot computer may serve as signal generating means 60. The preferred location for signal generating means 60 is on the forward face of the booster section 20 inside the connecting section 40 of the rocket. Phantom line 130 represents the raceway conductors. Arrows 140 and 150 indicate the forward end of the raceway and the aft end of the raceway, respectively. In a preferred embodiment, signal generating means 60 generates fin control signals for normal flight, a signal initiating payload-booster separation (separation command), signals to control yaw maneuvers after separation, and a signal to determine how long after separation the yaw maneuvers should commence. Thus, signal generating means 60** preferably comprises means for generating at least four separate types of signals.

An autopilot computer such as could serve as signal generating means 60 is conventionally located in the forward end of the booster due to a lack of space in the aft end. This subjects the computer to substantial shock during separation. The circuitry about to be described, however, to which the computer in essence transfers control of the fins, is located in the aft end and relatively protected from shock. An alternate placement of the signal generating means 60 is in the payload section 30. In this case, the signal lines from the signal generating means 60 are releasably connected to the remaining circuitry of FIG. 2, and are released at the time of payload-booster separation after transmission of the relevant control signals.

Referring again to FIG. 2, sample and hold means 70 is connected to summing point 120 through line 62*a*, which is the same line which connects switch 110 to summing point 120. Sample and hold means 70 is any of the well-known devices for retaining transient data for a fixed time. It stores the most recent fin control signal, and presents it on line 62*a* to summing point 120.

Switch 110 is controlled by the separation command issued by signal generating means 60 in a manner which will be described below.

Yaw maneuver command storage means 100 is switchably connected to summing point 120 through switch 160 and line 62*f*. It stores a series of fin control commands supplied it by signal generating means 60. It is also capable of presenting the fin control commands in a programmable sequence, each for a programmable length of time, as will be described below. Thus, yaw maneuver command storage means 100 can be any suitable digital memory with appropriate circuitry for presenting the contents of that memory in a programmable sequence.

Time delay means 80 is connected to signal generating means 60 by lines 62*c* and 62*d* so as to receive commands determining the period of delay, and also by line 62*b* to receive the separation command signal which commences the delay. Although this is shown as connections 62*b*, 62*c*, and 62*d*, it is understood that one connection could suffice. Time delay means 80 connects with and controls the state of switch 160 in a manner which will be described below.

Summing point 120 is a simple summing amplifier. Its output first passes to amplifier 170, the output of which in turn passes to fin actuating means 90. Fin actuating means 90 is any known means such as servo-motors with appropriate digital circuitry such as, perhaps, D/A converters, for producing mechanical motion in accordance with a series of electronic commands. In the preferred embodiment a signal representing the actual output of fin actuating means 90 is used to derive a feedback signal which is supplied to an inverting input of summing point 120 as indicated in FIG. 2.

It will be understood by one of ordinary skill in the art that the signals described above may be in any suitable format. In the preferred embodiment, standard 8-bit binary signals are used. The time delay signal, for example, may be coded so that the 8-bit signal represents a binary number corresponding to the delay in hundredths of a second, i.e., a "1" in every position would translate to a 2.55 second delay $[(2^8-1)\times 0.01]$. The yaw maneuver command signal is preferably 10 bytes long, the first byte identifying the next 9 bytes as the yaw maneuver command data, followed by 3 sets of 3 bytes, the first 2 bytes of each set defining a fin position and the last byte in each set defining the period of time the position defined by the other 2 bytes is to be held. Thus, there is capability for 3 separate positions with 3 hold times.

It will also be understood from the foregoing description that yaw maneuver command storage means 100 and time delay means 80 include circuitry which enables each to identify the portion of the data stream placed on line 62*c* by signal generating means 60 which is pertinent to the function of each. Specifically, time delay means 80 is provided with circuitry which enables it to identify that portion of the signals on line 62*c* comprising the time delay signal, while yaw maneuver command storage means 100 recognizes that portion of those signals which are yaw maneuver commands. Furthermore, lines 62*a*, 62*b*, and 62*c* may be a single line, with the three recipient means, 70, 80 and 100, all having circuitry enabling them to identify the portion of the data stream pertinent to each.

During the normal course of flight, switch 110 is closed, so that fin actuating commands for fin actuating means 90 originate from sample and hold means 70, which is periodically updated by signal generating means 60. Switch 160 is open, so that yaw command storage means 100 is normally not connected to the summing point 120.

Just prior to separation, signal generating means 60 sends a predetermined signal to time delay means 80 and provides yaw maneuver command storage means 100 with a series of electronic commands which will dictate fin positions through actuating means 90 after separation. Then, immediately prior to separation, signal generating means 60 supplies the final fin command to sample and hold means 70, and then initiates separation by issuing a separation command. This command causes switch 110 to open, and initiates running of the delay period of time delay means 80. Thus, immediately after separation occurs, the fin actuating means 90 continues to actuate fin movement as per the final command of signal generating means 60 which has been sampled and held within sample and hold means 70. After the delay determined by the signal sent from signal generating means 60 to time delay means 80, time delay means 80 closes switch 160, which connects yaw maneuver command storage means 100 to the summing point 120, so that the series of commands which were stored in yaw maneuver command storage means 100 are summed with those from sample and hold means 70. The resulting sum is amplified and presented to fin actuating means 90. Thus, the commands stored within yaw maneuver command storage means 100 incrementally control fin positioning. In the preferred embodiment, up to three fin position commands and associated time for holding these fin position commands are stored and these stored signals are sequentially presented to the fin actuating means 90 via summing point 120.

In the embodiment just described, the signals which ultimately control fin positioning are composites formed from the sum of the final fin actuating command sampled and held by sample and hold means 70 and the yaw maneuver commands stored in yaw command storage means 100. This is preferable to supplying non-composite signals because the starting fin position during separation is not known beforehand, having been changed as necessary for operational flight. It will be understood by one of ordinary skill in the art, however, that non-composite signals, i.e., signals derived solely from the yaw command storage means, could be used as well.

The components of one embodiment of a system according to the present invention have been described as separate functional block elements, the function of any one of which can be implemented in a manner apparent to one of ordinary skill in the art by using a suitably programmed and readily available microprocessor and appropriate electronic memory. In another preferred embodiment, the functions ascribed to the various blocks described above are carried out by a single microprocessor with memory. This microprocessor can be incorporated into fin actuating means 90 along with appropriate digital switches. Inasmuch as fin actuating means 90 is located near the fins 25 toward the base of booster 20, a microprocessor located therein will be relatively safe from damage from the shock of separation.

Although specific embodiments of the present invention have been described above, it will be readily apparent to one skilled in the art that the teachings of the invention may be carried over to other embodiments and other fields in which it is desirous to reduce the likelihood of collision between two bodies which have been separated in flight in which one of said bodies is provided with fins. Therefore, the present invention should not be regarded as limited to the embodiment just described in detail, but should be accorded the full scope of the following claims.

I claim:

1. An apparatus for separating a first segment and a finned second segment of an object in flight comprising:

means for generating yaw maneuver command signals effective for controlling the position of the fins to guide said second segment away from said first segment upon separation thereof;

means for generating a time delay signal;

means for generating a separation signal immediately prior to separation of said first and second segments;

means connected to the yaw maneuver command signal generating means for storing the yaw maneuver command signals and producing a stored signal;

means for controlling the positions of the fins in response to said stored yaw maneuver command signals; and time delay means connected to the time delay signal generating means and the separation signal generating means and responsive to the time delay signal and the separation signal for connecting the storing means to the controlling means after a time delay corresponding to the time delay signal, the delay commencing upon receipt of the separation signal by said time delay means.

2. An apparatus as claimed in claim 1 further comprising:

means for generating control signals during flight prior to separation;

a switch responsive to the separation signal and connected to the control signal generating means;

means connected to the switch for sampling and holding the control signal and producing a held signal; and means connected to the sample and hold means and the storing means for summing the held signal and the stored signal to produce a summed signal;

wherein the controlling means is responsively connected to the storing means and the sample and hold means through the summing means.

3. An apparatus as claimed in claim 2 wherein the means for generating yaw maneuver command signals, means for generating a time delay signal, means for generating a separation signal, and means for generating control signals collectively comprise signal generating means.

4. An apparatus as claimed in claim 3 in which the signal generating means comprises an autopilot computer located on the forward part of the second segment.

5. An apparatus as claimed in claim 4 further comprising amplifying means interposed between the summing means and the controlling means for amplifying the summed signal.

6. An apparatus as claimed in claim 5 wherein the storing means, the time delay means, the switch, the sample and hold means, the summing means, the amplifying means, and the controlling means are located on board the finned aft part of the second segment.

7. An apparatus for separating a payload section and a booster section of a rocket, the booster section being provided with controllable fins, comprising:

computer means for generating fin control signals, yaw maneuver command signals, a time delay signal, and a separation signal;

means connected to the computer means for storing the yaw maneuver command signals and for producing a stored signal;

means connected to the computer means for sampling and holding the fin control signal and producing a held signal;

means connected to the sample and hold means and switchably connected to the storage means for summing the stored signal and the held signal to produce a summed signal;

switch means connected to the computer means for disconnecting the sample and hold means from the computer means in response to the separation signal;

time delay means connected to the computer means for connecting the storage means to the summing means after a period which starts in response to the separation signal and lasts in accordance with the time delay signal; and fin activating means responsively connected to the summing means for controlling the position of the fins in response to the summed signal for steering said booster section away from said payload section after separation thereof.

8. A method of separating a first segment and a second segment of an object in flight, said second segment having fins controlled by a control unit comprising the steps of:

(a) generating yaw maneuver command signals;

(b) storing the generated yaw maneuver command signals on a storage means within said second segment;

(c) generating a time delay signal;

(d) storing said time delay signal on a storage device within said second segment;

(e) separating the first segment from the second segment; and (f) after said separating step, applying the stored yaw maneuver command signals to the control unit after a time delay corresponding to the stored time delay signal.

9. A method for separating a booster having controllable fins from a payload segment of a rocket comprising the steps of:

(a) generating and storing yaw maneuver command signals;

(b) generating and storing time delay signals;

(c) separating the booster segment and the payload segment; and (d) moving the fins in a predetermined sequence according to the yaw maneuver command signals after a predetermined time delay according to the time delay signals;

thereby imparting a spinning and tumbling motion to the booster segment and increasing drag forces and lateral aerodynamic forces on the booster segment to spatially separate said booster segment from said payload.

10. A method of separating a first segment and second segment of a rocket, the second segment having a computer on board its forward end and having fins on its aft end controlled by a control unit, comprising:

(a) generating yaw maneuver command signals in the on-board computer;

(b) storing the generated yaw maneuver command signals in the control unit;

(c) generating a time delay signal in the on-board computer;

(d) storing the generated time delay signal in the control unit;

(e) generating a final fin command signal in the on-board computer;

(f) storing the generated final fin command signal in the control unit;

(g) separating the first segment and the second segment;

(h) controlling the fins according to the final fin command signal until the end of a time delay corresponding to the time delay signal;

(i) adding the final fin command signal and the yaw maneuver command signal to produce a summed signal; and (j) controlling the fins according to the summed signal after the time delay.

* * * * *